US007040502B2

(12) United States Patent
Phelps et al.

(10) Patent No.: US 7,040,502 B2
(45) Date of Patent: May 9, 2006

(54) DISPENSER FOR WET AND DRY INTERFOLDED SHEETS

(75) Inventors: Stephen L. Phelps, Lilburn, GA (US); Debra N. Welchel, Woodstock, GA (US); Joseph Mitchell, Alpharetta, GA (US)

(73) Assignee: Kinberly-Clark Worldwide, Inc., Neenah, WI (US)

( * ) Notice: Subject to any disclaimer, the term of this patent is extended or adjusted under 35 U.S.C. 154(b) by 50 days.

(21) Appl. No.: 10/329,932

(22) Filed: Dec. 26, 2002

(65) Prior Publication Data

US 2004/0124203 A1 Jul. 1, 2004

Related U.S. Application Data

(63) Continuation-in-part of application No. 10/304,987, filed on Nov. 26, 2002, now Pat. No. 6,857,540, and a continuation-in-part of application No. 10/304,570, filed on Nov. 26, 2002.

(51) Int. Cl.
*A47K 10/24* (2006.01)

(52) U.S. Cl. ..... 221/34; 221/45

(58) Field of Classification Search ..... 221/34, 221/35, 45, 63, 283, 282, 47, 46, 197, 286, 221/287; 242/422.4, 422.9, 599.3, 598.5
See application file for complete search history.

(56) References Cited

U.S. PATENT DOCUMENTS

| | | | | |
|---|---|---|---|---|
| 2,122,048 | A | 6/1938 | Shapiro | |
| 2,181,207 | A * | 11/1939 | Sanford | 242/598.1 |
| 2,374,586 | A * | 4/1945 | Dessaur | 242/598.3 |
| 2,738,898 | A * | 3/1956 | Lee | 221/35 |
| 2,765,909 | A | 10/1956 | Graham | |
| RE24,906 | E | 12/1960 | Ulrich | |
| 3,037,718 | A * | 6/1962 | Pettit | 242/598.3 |
| 3,301,746 | A | 1/1967 | Sanford et al. | |
| 3,322,617 | A | 5/1967 | Osborne | |
| 3,770,221 | A * | 11/1973 | Stern | 242/422.4 |
| 3,824,953 | A | 7/1974 | Boone | |
| 3,836,044 | A | 9/1974 | Tilp et al. | |
| 3,837,595 | A | 9/1974 | Boone | |
| 3,857,731 | A | 12/1974 | Merrill, Jr. et al. | |
| 3,921,802 | A | 11/1975 | Thompson | |
| 3,986,479 | A | 10/1976 | Bonk | |
| 3,995,582 | A | 12/1976 | Douglas | |
| 4,106,616 | A | 8/1978 | Boone | |
| 4,106,617 | A | 8/1978 | Boone | |

(Continued)

FOREIGN PATENT DOCUMENTS

EP 575677 A1 * 12/1993

(Continued)

*Primary Examiner*—Donald P. Walsh
*Assistant Examiner*—Matthew J. Kohner
(74) *Attorney, Agent, or Firm*—Sue C. Watson

(57) ABSTRACT

A non-refillable dispenser containing both premoistened and dry sheets is provided. The dispenser includes a housing having a polygonal shape. The housing has a first compartment configured to hold and dispense therefrom a plurality of premoistened sheets, and a second compartment configured to hold and dispense therefrom a plurality of dry sheets. A dispensing opening is defined in each of the first and second compartments for dispensing the sheets therefrom. At least one pair of openings is positioned through at least one of the first and second compartments of the housing. The openings are configured to receive a roll mount of a standard rolled bath tissue fixture therethrough. The dispenser is coupled to the roll mount, which is coupled to the fixture.

22 Claims, 6 Drawing Sheets

U.S. PATENT DOCUMENTS 4,190,321 A 2/1980 Dorer et al.
4,191,317 A * 3/1980 Harkins ..... 225/77
4,205,802 A * 6/1980 Economakis ..... 242/594.5
4,235,333 A 11/1980 Boone
4,610,357 A 9/1986 Nakamura
4,620,502 A 11/1986 Kimble
4,638,921 A 1/1987 Sigl et al.
4,651,874 A 3/1987 Nakamura
4,653,250 A 3/1987 Nakamura
4,739,879 A 4/1988 Nakamura
4,741,944 A 5/1988 Jackson et al.
4,834,316 A 5/1989 DeLorean
4,865,221 A 9/1989 Jackson et al.
4,913,312 A 4/1990 Boutin
4,919,350 A * 4/1990 Miller ..... 242/423
5,048,589 A 9/1991 Cook et al.
5,194,299 A 3/1993 Fry
5,265,758 A 11/1993 Saint Criq et al.
5,311,986 A 5/1994 Putz
5,399,412 A 3/1995 Sudall et al.
5,409,181 A 4/1995 Patrick
5,439,521 A 8/1995 Rao
5,509,593 A * 4/1996 Bloch et al. ..... 225/37
D377,284 S * 1/1997 Farrow et al. ..... D6/519
5,607,551 A 3/1997 Farrington et al.
5,618,008 A 4/1997 Dearwester et al.
5,624,025 A * 4/1997 Hixon ..... 206/233
5,629,081 A 5/1997 Richards et al.
5,656,361 A 8/1997 Vogt et al.
5,660,636 A 8/1997 Shangold et al.
5,672,248 A 9/1997 Wendt et al.
5,752,622 A * 5/1998 Abell ..... 221/97
5,765,717 A 6/1998 Gottselig
5,845,870 A * 12/1998 Angle ..... 242/598.5
5,897,074 A 4/1999 Marino
5,899,407 A * 5/1999 Hall, III ..... 242/598.3
5,950,960 A 9/1999 Marino
5,951,762 A 9/1999 Shangold et al.
5,964,351 A 10/1999 Zander
5,971,138 A * 10/1999 Soughan ..... 206/210
6,047,920 A 4/2000 Dearwester et al.
6,056,235 A 5/2000 Brozinsky
6,098,836 A 8/2000 Gottselig
6,138,939 A * 10/2000 Phelps et al. ..... 242/596.7
6,170,698 B1 1/2001 Phelps et al.
6,230,929 B1 5/2001 Phelps et al.
6,273,359 B1 * 8/2001 Newman et al. ..... 242/595
6,346,153 B1 2/2002 Lake et al.
6,382,552 B1 5/2002 Paul et al.
6,409,120 B1 * 6/2002 Tramontina et al. ..... 242/594.5
6,439,386 B1 * 8/2002 Sauer et al. ..... 206/494
6,540,195 B1 * 4/2003 Newman et al. ..... 248/544
6,588,626 B1 * 7/2003 Sauer et al. ..... 221/49
6,592,068 B1 * 7/2003 Taylor et al. ..... 242/596.8
6,736,287 B1 5/2004 Sauer et al.
2004/0099679 A1 * 5/2004 Welchel et al. ..... 221/34
2004/0099680 A1 * 5/2004 Mitchell ..... 221/45
2005/0077309 A1 * 4/2005 Mitchell et al. ..... 221/45

FOREIGN PATENT DOCUMENTS

EP 1129656 A1 9/2001
WO 94/14365 7/1994
WO 98/04486 2/1998
WO 00/65973 11/2000
WO 01/76436 10/2001
WO 01/76440 10/2001
WO 01/89935 11/2001
WO 02/21988 3/2002
WO 02/21989 3/2002

* cited by examiner

DISPENSER FOR WET AND DRY INTERFOLDED SHEETS

CROSS REFERENCE TO RELATED APPLICATIONS

This application is a continuation-in-part of U.S. Ser. No. 10/304,987, filed Nov. 26, 2002, now U.S. Pat. No. 6,857,540, entitled "AN INTERFOLDED TISSUE SHEET DISPENSER WITH ADJUSTABLE ATTACHING MECHANISM" by J. Mitchell; this application is also a continuation-in-part of U.S. Ser. No. 10/304,570, filed Nov. 26, 2002, entitled "A DISPENSER FOR WET AND DRY INTERFOLDED TISSUE" by D. Welchel and J. Mitchell.

BACKGROUND OF THE INVENTION

The use of premoistened or "wet" sheets has gained wide acceptance for a variety of uses, particularly premoistened bathroom applications. The premoistened sheets are generally formed from an absorbent material such as a paper or a polymeric web, or combinations thereof, and may contain a disinfectant, medicant, deodorant, anti-microbial, anti-bacterial, cleansing agent, and so forth, in one or more combinations, in the "wet" formulation. The sheets are generally stored and dispensed from a sealable container to prevent the sheets from drying out.

Various premoistened dispenser designs have been used with existing bathroom fixtures, such as fixtures for conventional rolled products. These separate or combined dispensers are often cumbersome and bulky, and they are problematic with regard to space and mounting considerations. Refilling one or both dispensers can also be difficult.

Accordingly, it would be desirable to provide a dispenser capable of dispensing wet and dry sheets simultaneously from a common fixture. In addition, it would be desirable to provide a non-refillable, disposable dispenser that is adapted for use in a conventional rolled product dispenser.

DEFINITIONS

As used herein, the term "fasteners" means devices that fasten, join, connect, secure, hold, or clamp components together. Fasteners include, but are not limited to, screws, nuts and bolts, rivets, snap-fits, tacks, nails, loop fasteners, and interlocking male/female connectors, such as fishhook connectors, a fish hook connector includes a male portion with a protrusion on its circumference. Inserting the male portion into the female portion substantially permanently locks the two portions together.

As used herein, the term "hinge" refers to a jointed or flexible device that connects and permits pivoting or turning of a part to a stationary component. Hinges include, but are not limited to, metal pivotable connectors, such as those used to fasten a door to frame, and living hinges. Living hinges may be constructed from plastic and formed integrally between two members. A living hinge permits pivotable movement of one member in relation to another connected member.

As used herein, the term "couple" includes, but is not limited to, joining, connecting, fastening, linking, or associating two things integrally or interstitially together.

These terms may be defined with additional language in the remaining portions of the specification.

SUMMARY OF THE INVENTION

In response to the difficulties and problems discussed above, a non-refillable dispenser containing both premoistened and dry sheets is provided. The non-refillable dispenser includes a housing having a polygonal shape. The housing has a first compartment configured to hold and dispense therefrom a plurality of premoistened sheets and a second compartment configured to hold and dispense therefrom a plurality of dry sheets. The dispenser has a dispensing opening defined in each of the first and second compartments for dispensing the sheets therefrom. In addition, the dispenser includes at least one pair of openings positioned through at least one of the first and second compartments of the housing. The openings are configured to receive a roll mount of a standard rolled bath tissue fixture therethrough, which is used to couple the dispenser thereto. The housing has a width dimension which is less than a length dimension of a roll mount.

In another aspect of the invention, a dispensing system is provided. The dispensing system includes a standard rolled bath tissue fixture. The fixture has a pair of spaced-apart and confronting support arms positioned to engage a roll mount which extends therebetween. The dispensing system also includes a non-refillable, disposable dispenser. The non-refillable, disposable dispenser includes a housing having a polygonal shape. The housing has a first compartment configured to hold and dispense therefrom a plurality of premoistened sheets, and a second compartment configured to hold and dispense therefrom a plurality of dry sheets. The housing is configured to fit between the support arms of the fixture when positioned therebetween. The dispenser has a dispensing opening defined in each of the first and second compartments for dispensing the sheets therefrom. In addition, the dispenser includes at least one pair of openings positioned through at least one of the first and second compartments of the housing. The roll mount is positioned through the openings and supports the housing in the fixture in a fixed position to facilitate easy removal of premoistened sheets and dry sheets from the housing.

DETAILED DESCRIPTION

Figure 1:
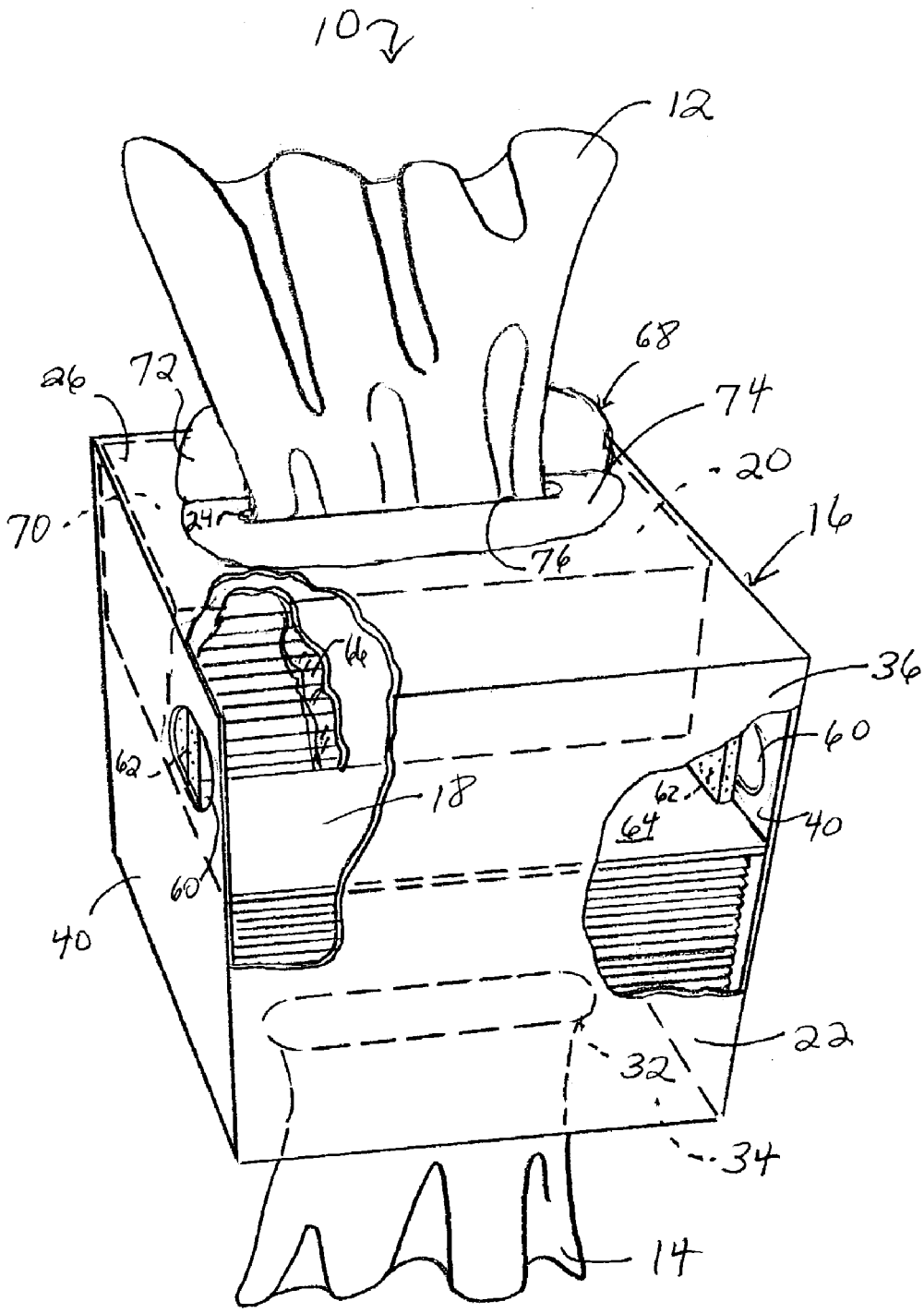
FIG. 1 is a perspective view of a first embodiment of the dispenser of the present invention, showing a first compartment and a second compartment.

Reference will now be made in detail to one or more embodiments of the invention, examples of which are illustrated in the drawings. Each example and embodiment is provided by way of explanation of the invention, and not meant as a limitation of the invention. For example, features illustrated or described as part of one embodiment may be used with another embodiment to yield still a further embodiment. It is intended that the invention include these and other modifications and variations as coming within the scope and spirit of the invention.

Referring to the figures in general, a dispenser is provided for storing and dispensing both premoistened sheets and dry sheet from a single dispenser housing. It should be appreciated that the present invention is not limited to any particular type of dry or premoistened sheets. The dispenser is well suited for dispensing individual stacked interfolded sheets, as generally illustrated in the figures. Non-limiting examples of premoistened sheets are disclosed in U.S. Pat. Nos. 4,741,944 and 4,865,221, both to Jackson et. al., U.S. Pat. No. 5,629,081 to Richards et al., U.S. Pat. No. 5,656,361 to Vogt et al., and U.S. Pat. No. 5,964,351 to Zander, all of which are incorporated by reference in there entirety herein. Non-limiting examples of dry sheets are disclosed in U.S. Pat No. 3,301,746 to Sanford et al., U.S. Pat. No. 3,322,617 to Osborne, U.S. Pat. No. 5,048,589 to Cook et al., U.S. Pat. No. 5,399,412 to Sudall et al., U.S. Pat. No. 5,607,551 to Farrington et al., and U.S. Pat. No. 5,672,248 to Wendt et al., all of which are incorporated by reference herein in their entirety. Such stack configurations for dry or premoistened sheets are well known to those of ordinary skill in the art and need not be described in great detail herein.

Figure 2:
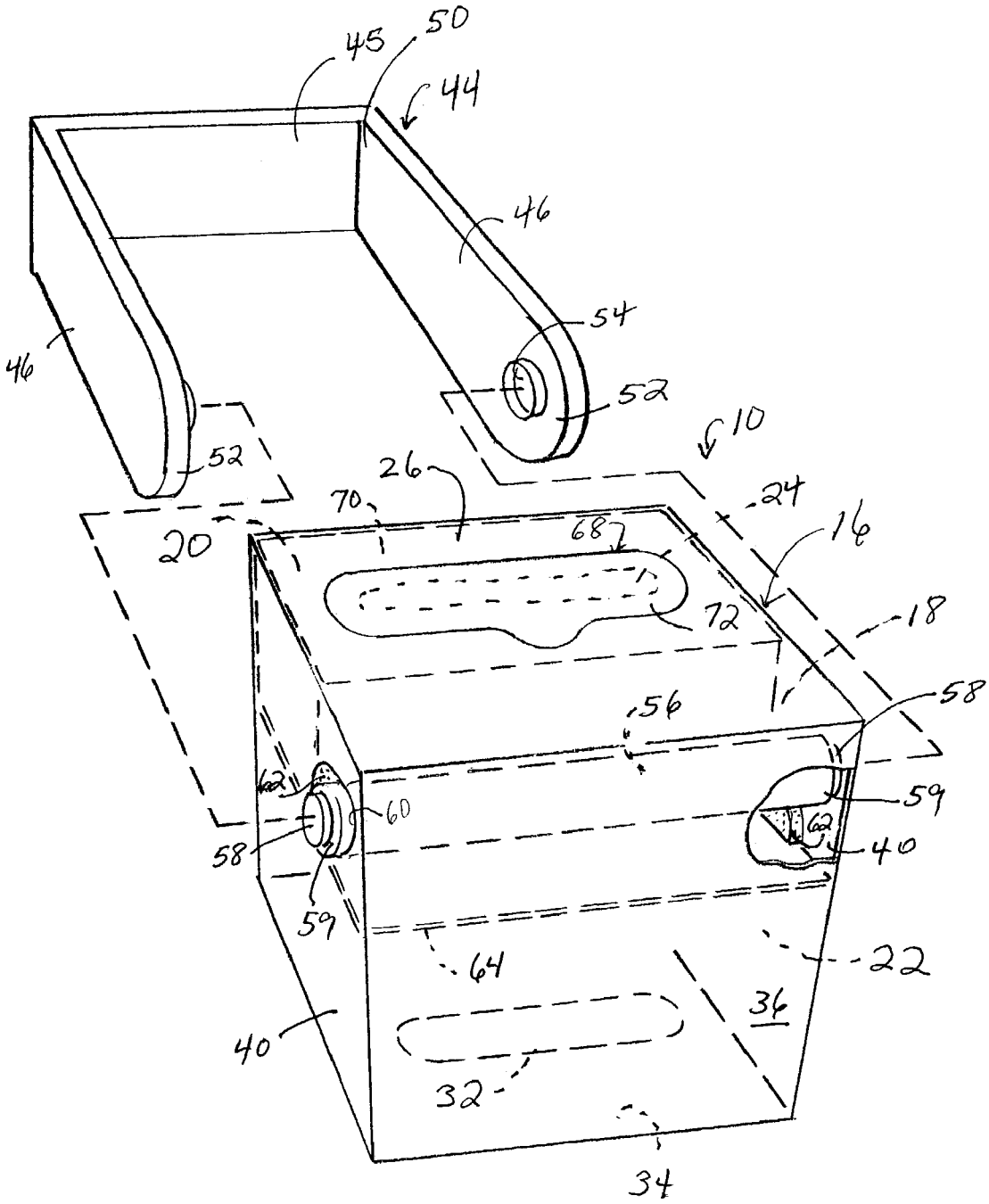
FIG. 2 is an exploded perspective view of the dispenser of the first embodiment and a standard rolled product bath fixture with a roll mount of the fixture positioned in the dispenser.

As illustrated in FIGS. 1–5, a dispenser 10 according to the invention is provided for dispensing promoistened sheets 12 and dry sheets 14 from a single housing unit 16. The housing 16 includes a first compartment 18 in which a container 20 of premoistened sheets 12 is stored, and from which the premoistened sheets 12 are dispensed, as shown in FIGS. 1 and 2. The housing 16 also includes at least a second compartment 22 in which dry sheets 14 are stored and from which the sheets 14 are dispensed.

A first dispensing opening 24 is defined in the housing 16 to permit access to the first compartment 18 or the container 20 of premoistened sheets 12 therein. The first dispensing opening 24 desirably is provided, by way of non-limiting example, on an upper wall or upper surface 26 of the housing 16. Any wall or surface of the housing 16 may be used, however, to dispense the premoistened sheets 12. The container 20 of premoistened sheets 12 is exposed through the first dispensing opening 24, which provides access thereto.

Similarly, a second dispensing opening 32 is provided in the housing 16 to permit access to the dry sheets 14 contained in the second compartment 22. The second dispensing opening 32 is provided, for example, but not by way of limitation, in a lower wall or lower surface 34 of the housing 16, a front wall 36 of the housing 16, and any combination thereof. The dispensing openings 24 and 32, however, may be provided in any wall structure(s), wall(s), and/or portion(s) of the housing 16. It will be appreciated that the dispensing openings 24 and 32 may take on any suitable shape or configuration. The dispensing openings shown and/or described herein may be covered, for example, but not by way of limitation, by a plastic film (not shown), and so forth. The dispensing openings may be formed from perforated portions that, when removed, provide the openings (not shown), and so forth.

Figure 3:
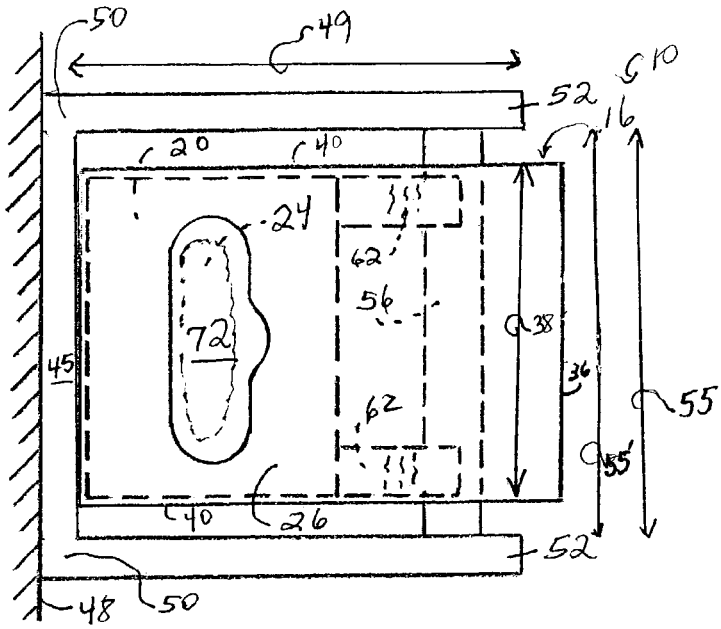
FIG. 3 is a top plan view of the dispenser of the first embodiment positioned on the fixture.
Figure 4:
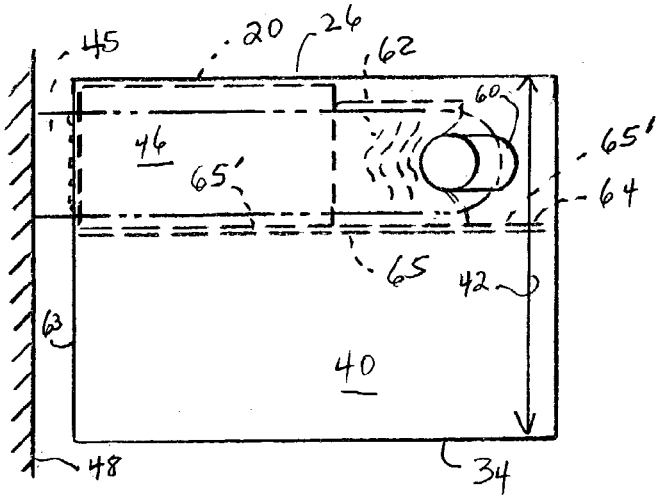
FIG. 4 is a side view of the dispenser of the first embodiment positioned on the fixture.
Figure 5:
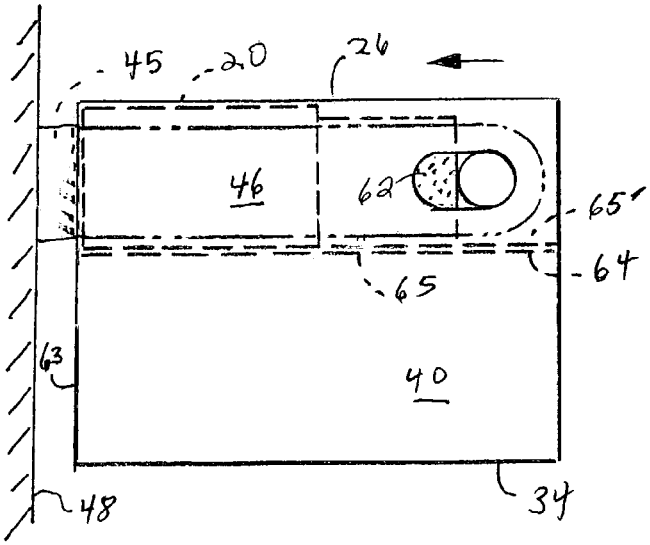
FIG. 5 is another side view of the dispenser of the first embodiment positioned on the fixture.

Referring to FIGS. 3–5, the housing 16 has a configuration with a width dimension 38 between opposing side walls 40, a length dimension 41 between front and back walls 36, 63 and a depth dimension 42 between upper and lower surfaces 26 and 34 so as to be supported by a conventional roll product fixture. Such fixtures are well known and a typical fixture 44 is illustrated in FIGS. 2–5 as having a base or back member 45 and a pair of transversely extending side support arms 46. Alternatively, fixtures 44' (FIGS. 6–9) have side support arms 46 mounted to and extending transversely from a generally vertically disposed support surface 48. As shown in FIGS. 2 and 3, each of the support arms 46 has a length 49 which extends from a coupled end 50 to a free end 52 of the arm 46. A divot or recess 54 is typically provided near each free end 52. The support arms 46 also have a width dimension 55 between each support arm 46 across which a roll mount 56 extends and which also generally corresponds to a length dimension 55' of the roll mount 56. The width 55/length 55' is typically in a range of about 6.0 inches (15.2 cm) to about 4.0 inches (10.2 cm). Desirably, the width 55/length 55' is in a range of about 5.6 inches (14.2 cm) to about 4.75 inches (12.1 cm). It will be appreciated that the width dimension 38 of the housing 16 is less than the width 55 between the support arms, and less than the length 55' of the roll mount 56 which extends across the width 55. That is, the housing 16 desirably has a width 38 in a range of about 5.5 inches (14 cm) to about 4.70 inches (11.9 cm). Even more desirably, the housing has a width in a range of about 5.25 inches (13.3 cm) to about 4.6 inches (11.7 cm). Yet even more desirably, the housing has a width in a range of about 5.25 inches (13.3 cm) to about 4.5 inches (11.4 cm).

Figure 13:
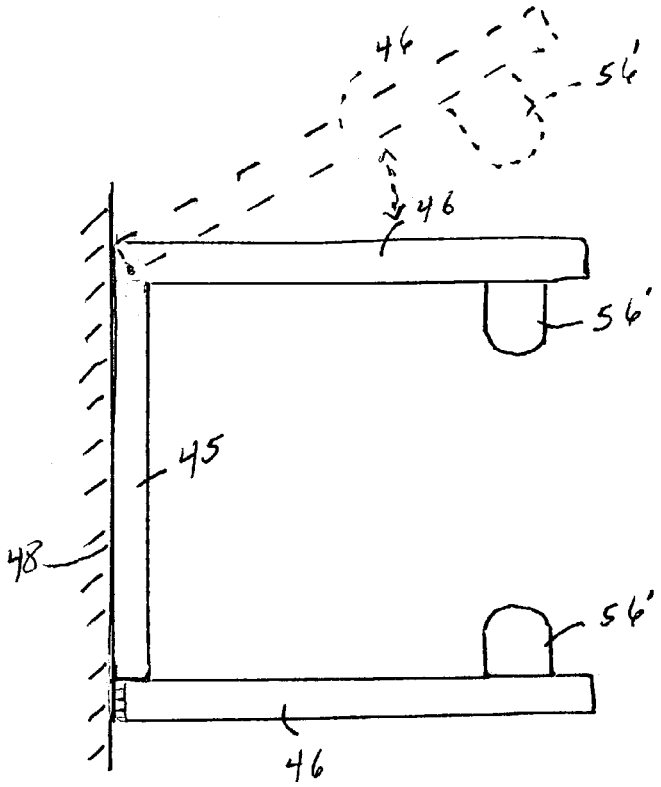
FIG. 13 is a top plan view of a cored or coreless roll dispenser.

The roll mount 56, in the present embodiment, for example, a conventional spindle, is provided. In the present embodiment, the roll mount 56 has connecting or protruding members 58 on each end 59 is typically inserted through a hollow core of a roll product and the protruding members 58 are received in the recesses 54. The roll mount 56 is received through a portion of the housing 16 in order to couple the dispenser 10 to the fixture 44 or 44'. As used herein, the term "roll mount" includes a spindle, and also includes a pair of prongs 56' mounted on each arm 46 or side portion of a fixture, such as may be used with a coreless bath tissue roll, shown generally in FIG. 13, one nonlimiting example of which is illustrated and described in detail in U.S. Pat. No. 5,620,148 to J. Mitchell, which is hereby incorporated by reference in its entirety herein.

The dispenser 10 has at least one positioning means such as a pair of slots 60, as illustrated in FIGS. 2 and 3–5. A resilient material 62 may be positioned adjacent each slot 60 to partially block a portion of each slot 60. The resilient material 62 is desirably a natural or a synthetic foam, sponge, and/or rubber, and combinations thereof. The resilient material 62 may comprise any material which when compressed and then uncompressed permits the resilient material to spring back to its original size, shape, position, and so forth.

The roll mount 56 of the fixture 44 is positioned to extend through each slot 60, as illustrated in FIGS. 2–5. That is, the slots 60 in the housing 16 are configured, in the present embodiment, so that the roll mount 56 extends through the side walls 40 and adjacent the upper surface 26 of the housing 16. The housing 16 is configured so that each end 59 of the roll mount 56 and the protruding member 58 thereon extends out of each slot 60, as shown in FIG. 2. The protruding members 58 typically releasably couple to the recesses 54 on each free end 52 of each of the side support arms 46, thereby firmly pressing a back wall 63 the housing 16 against at least one of: (a) the coupled ends 50 of the side support arms 46, (b) the back member 45, and/or (c) the support surface 48, thereby securing the housing 16 of the dispenser 10 in a relatively fixed and unmovable position in the fixture 44. Since the length 49 of the support arms 46 may vary among different fixtures, the resilient material 62 positioned adjacent to and blocking a portion of each slot 60 is configured to compress if the length 49 of the side support arms 46 is relatively short (FIG. 4), but to fill in at least a portion of the slots 60 if the length 49 of the side support arms 46 is relatively long (FIG. 5). In either alternative, the resilient material 62 assists in moving the roll mount 56 to a position where the back wall 63 is positioned against one of the previously described elements, as illustrated in FIGS. 3–5, so that unwanted rotation or movement of the housing 16 is prevented. It will be understood that the slots 60 and/or the roll mount 56 may be positioned adjacent or through any compartment(s), wall(s), surface(s) and/or portion(s) of the housing 16.

Alternatively, the resilient material, or a material attached thereto (not shown), may contain an aperture through which the roll mount is positioned, in order to hide or mask the larger slots. It will be understood that the resilient material will act as previously described herein to position the housing in a fixed position for dispensing sheets therefrom.

The housing 16 is desirably a non-refillable, disposable housing 16 which may be formed from any conventional material, and may be a relatively inexpensive cardboard, paperboard, plastic, any combinations thereof, and so forth. Alternatively, the housing 16 has a separate sidewall which is hinged or coupled thereto to permit refilling (not shown). As illustrated in FIGS. 1, 2, 4 and 5, the housing 16 desirably is an integral unit such that the first and second compartments 18 and 22 are joined and non-separable. For example, the first and second compartments 18 and 22 may be formed separately, but be bonded or coupled together, by way of heat sealing, adhesively sealing, ultrasonically sealing, stapling, taping, shrink wrapping, and so forth. In another example, the housing 16 may contain an internal wall 64, as shown in FIGS. 1, 2, 4 and 5. This wall 64 may define a lower surface 65 of the first compartment 18 as well as an upper surface 65' of the second compartment 22. It may be desired to form at least a portion of the housing 16 from a liquid impermeable material so as to properly contain the premoistened sheets 12. However, portion(s) of the housing 16 may be formed partially or entirely of any type of material, including a liquid absorbent or liquid impermeable material. For example, the premoistened sheets 12 may be encased in a liquid impermeable film 66, as illustrated generally in FIG. 1, and this film 66 may provide a portion, or all, of the container 20 and/or the first compartment 18 (not shown). In a further example, the film 66 may provide all or a portion of the internal wall 64 (not shown). Alternatively, one or more compartments 18, 22 of the housing 16 may be lined with the film 66 (not shown). The premoistened sheets 12 may be provided in the container 20 which is lined with film 66, as illustrated in FIG. 1. The container 20 desirably will be smaller than the compartment in which it is contained, or the container may form the first compartment without need for an internal wall 64 (not shown). Further, the container 20 may be movable within the compartment, to accommodate a roll mount positioned adjacent to it, as shown generally in FIGS. 1–8.

As shown in FIGS. 1 and 2, the resealable cover 68 is positioned over the first dispensing opening 24 in the housing 16, which permits access to the premoistened sheets 12, which are disposed in the container 20 which is positioned in the first compartment 18. Alternatively, or in addition thereto, the container 20 for the premoistened sheets 12 may include a resealable cover (not shown) which is positioned on an upper surface 70 of the container 20 to permit access to the premoistened sheets 12 through an opening in the container 20 (not shown). Such a resealable cover is accessed through the first dispensing opening 24 in the housing 16.

The resealable cover 68 serves to maintain the moisture conditions within the first compartment 18 and/or the container 20 and prevents undesired drying out of the premoistened sheets 12. The resealable cover 68 includes an upper flap 72 which is coupled to a portion of a lower flap 74, which has a slit or opening 76 therein, through which the premoistened sheets 12 are withdrawn. The resealable cover 68 may be is positioned over the first dispensing opening 24 in the first compartment 18, an opening (not shown) in the container 20, or both (not shown). The upper flap 72 releasably engages the lower flap 74 to provide a releasable closure to the first compartment 18 and/or the container 20. Such releasable and resealable features between the upper and lower flaps 72, 74 is provided, by way of non-limiting example, by an adhesive, such as a pressure sensitive adhesive, a cohesive adhesive, such as a latex or other natural rubber material, and so forth. The present resealable cover 68 is presented herein by way of example, and not by way of limitation. Other resealable mechanisms, such as, by way of non-limiting example, snap-fit, hinged cover and lid, and so forth are known, and any commercially available resealable mechanism may be used with any compartment 18, 22 or container 20.

It will be appreciated that the housing 12 of the dispenser 10 may take on any configuration, however, a generally polygonal shape is desirable. The generally rectangular, box-shaped configuration of the present embodiments, however, is for nonlimiting illustrative purposes only. It will also be understood that the first and second compartments 18 and 22 may be reversed in position, need not be in a stacked configuration, and may take on any suitable arrangement, including a side-by-side arrangement, a coaxial arrangement, and so forth. Any number of compartments and/or configurations may be used for simultaneously dispensing dry and premoistened sheets from a single housing, the housing being supported by a roll product dispenser fixture. All such configurations are within the scope and spirit of the present invention.

Figure 6:
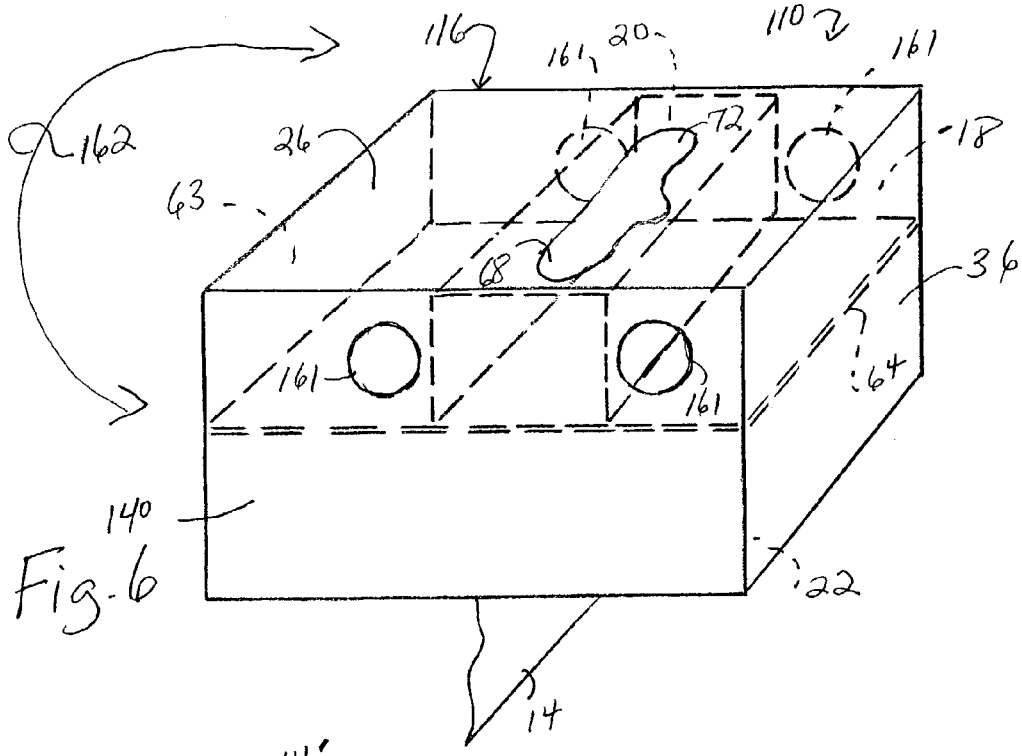
FIG. 6 is a perspective view of another embodiment of the dispenser of the present invention.
Figure 7:
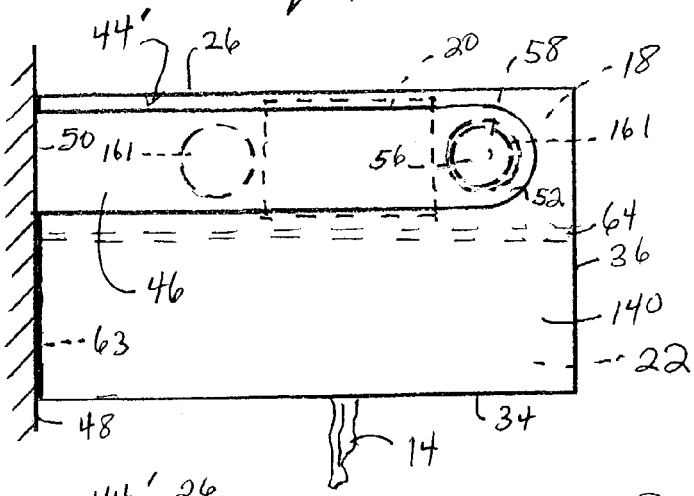
FIG. 7 is a side view of the embodiment of FIG. 6, but positioned on a fixture.
Figure 8:
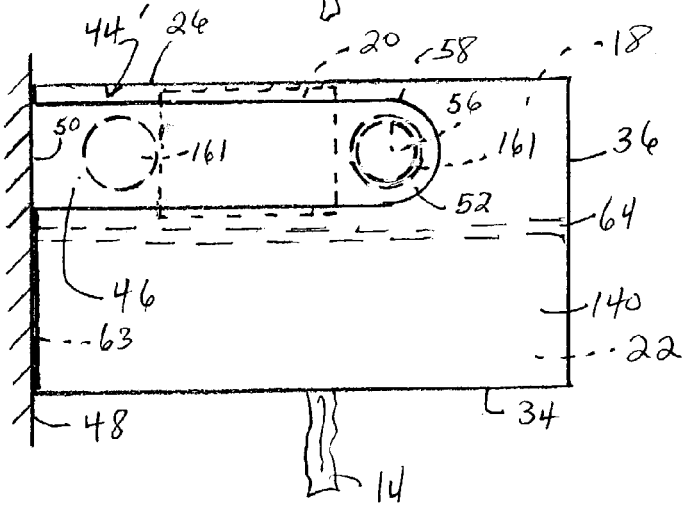
FIG. 8 is another side view of the embodiment of FIG. 6, positioned on a fixture.
Figure 10:
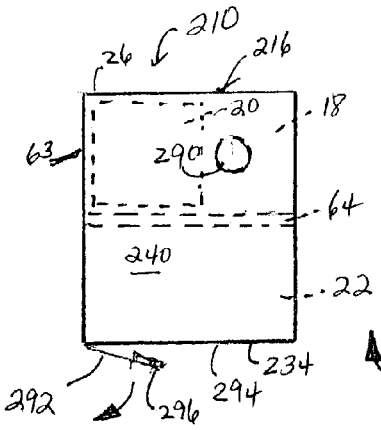
FIG. 10 is a side view of the embodiment of FIG. 9, showing the securing flap positioned adjacent the lower surface of the dispenser being unfolded outward.

In another embodiment of the invention, as illustrated in FIGS. 6–8, the dispenser 110 and housing 116 are similar to the dispenser 10 and the housing 16 shown in FIGS. 1–5 and previously described in detail herein. The housing 116, however, includes a positioning means such as a plurality of apertures 161 provided on opposing side walls 140. The plurality of apertures 161 are provided to accommodate different lengths of side support arms 46 of various fixtures 44'. That is, some apertures 161 are positioned in the sidewalls 140 to accommodate shorter side support arms 46 of a fixture 44'. Other apertures 161 are positioned in the sidewalls 140 to accommodate longer side support arms 46 of a fixture 44'.

As illustrated in FIG. 8, the side support arms 46 have a relatively shorter length 49. Therefore, the roll mount 56 of the fixture 44' is inserted into apertures 161 that are similar to the length 49 of the side support arms 46, so that the back wall 63 of the housing 116 will be held securely against at least one of: (a) the coupled ends 50 (not shown) and/or (b) the support surface 48. The plurality of apertures 161 are provided to adapt to different lengths of side support arms 46 of the fixture 44', such as the relatively longer length 49 of the side support arms 46 shown in FIG. 7. Such adaptation is provided by turning the housing 116 around in a direction 162 by 180 degrees, as illustrated in FIG. 6, so that the plurality of apertures 161 are presented at different positions relative to the length of the side support arms 46. Turning the housing 116 provides apertures in a position to accommodate most different lengths of side support arms 46 of different fixtures 44', which may not be accommodated by the housing 116 in its previous position, as shown in FIGS. 7 and 8. It will also be appreciated that any number and location of apertures 161 may be provided in any structure (s), wall(s), surface(s), and/or portion(s) of the housing 116 to permit the present dispenser 110 to be supported by a standard bath roll product dispenser fixture. Desirably, the container 20 holding the premoistened sheets 12 will be movable within the compartment in which it is contained within the housing 116 to accommodate the position of the roll mount 56 inserted therethrough, as shown generally in FIG. 6. Alternatively, the container 20 is positioned within the compartment to avoid the roll mount 56 when it is disposed through the housing 116.

Figure 11:
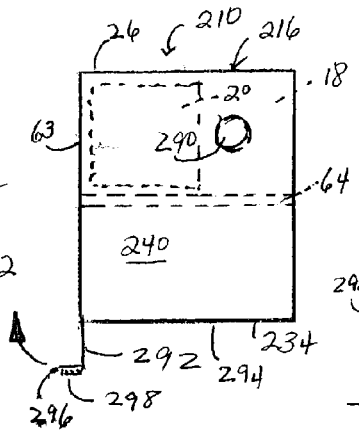
FIG. 11 is another side view of the embodiment of FIG. 9, showing the securing flap being positioned.
Figure 12:
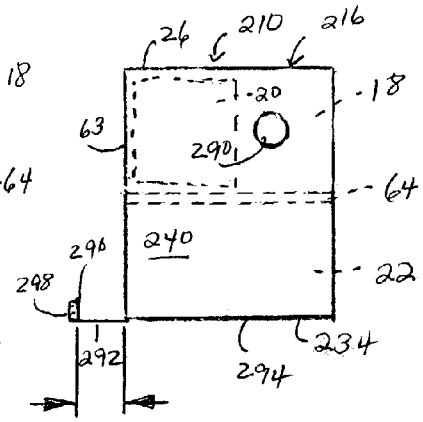
FIG. 12 is yet another side view of the embodiment of FIG. 9, showing the securing flap with a connecting member thereon.
Figure 9:
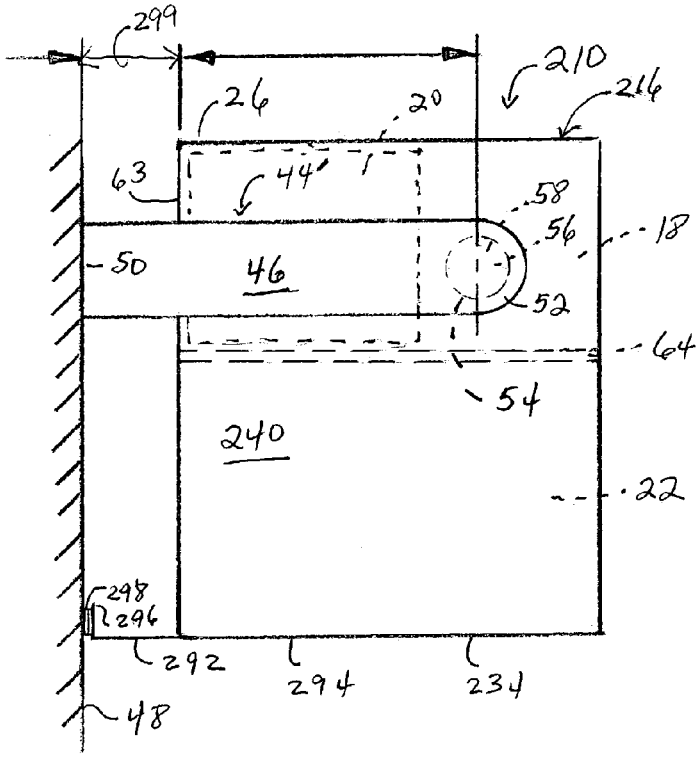
FIG. 9 is a side view of another embodiment of the present invention, showing the dispenser positioned on a fixture and a securing flap positioned against a support surface for securing the dispenser in a fixed, unmovable position for dispensing.

In yet another embodiment of the present invention, a dispenser 210 similar to the dispensers 10, 110 shown in FIGS. 1–5 and 6–8, respectively, and described in detail herein is provided. As shown in FIGS. 9–12, the dispenser 210 includes positioning means or a single pair of apertures 290 which are provided in opposite sidewalls 240 of the housing 216. In addition, a securing means or securing flap 292 is provided on an outer surface 294 of the housing 216, in this instance, but not by way of limitation, on a lower surface 234 thereof, as shown generally in FIG. 10. As illustrated in FIGS. 9, 11 and 12, the securing flap 292 includes a free end 296. At least a portion of the free end 296 includes an additional securing means or contact member 298, such as, by way of non-limiting example, an adhesive, such as a pressure sensitive adhesive, one or more suction cups, and so forth.

The roll mount 56 of a fixture 44 is inserted through the apertures 290, as shown in FIG. 9, and each protruding member 58 is releasably coupled to one of the recesses 50 (FIG. 2) of the side support arms 46. The housing 216 is positioned a distance 299 from the back member 45 and/or the support surface 48. The free end 296 of the securing flap 292 is detached from its position against the housing 216. The free end 296 is positioned such that the contact member 298 is positioned against at least one of the back member (not shown) or the support surface 48 illustrated in FIG. 9, to secure the housing 216 in a relatively fixed, unmovable position, and to prevent unwanted movement or rotation of the housing 216.

Figure 14:
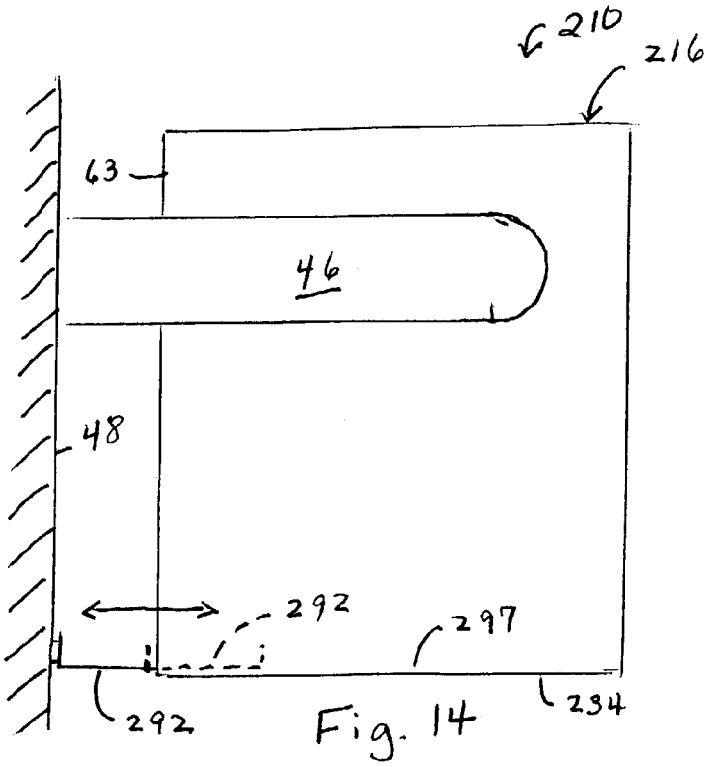
FIG. 14 is still yet another side view of the embodiment of FIG. 9, showing the securing flap as a sliding securing flap which is positioned in the housing (shown in phantom lines) prior to being moved outward to secure the housing in a dispensing position.

The securing flap 292 may be provided as a slide-out flap, as illustrated in FIG. 14, which is positioned adjacent on an inner surface 297 opposite the lower surface 234 of the dispenser 210. The flap 292 (shown in phantom in its non-dispensing position) is moved out of its non-dispensing position adjacent an inner surface of the housing 216 and moved into a position against the support surface 48, as described above. The securing flap 292 may be provided from any wall and/or surface of the dispenser 210. It will be understood that the securing flap 292 may be utilized with any embodiment shown and/or described herein. It will be appreciated that the housing of any embodiment shown and/or described herein may be secured to any portion of a roll product fixture and/or a support surface by other securing means. Such securing means include, but is not limited to, tape, bars, fasteners, plastic or elastomeric strips or strings, hook and loop fasteners, any combination thereof, and so forth.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed is:

1. A non-refillable dispenser containing both premoistened and dry sheets, comprising:

a housing including a first compartment configured to hold and dispense therefrom a plurality of premoistened sheets and a second compartment configured to hold and dispense therefrom a plurality of dry sheets, a dispensing opening defined in each of the first and second compartments for dispensing sheets therefrom; and at least one pair of openings positioned through at least one compartment of the housing, the openings positioned on opposing side walls, each opening defining a slot having a resilient material positioned to partially block each slot to resiliently hold a roll mount of a standard rolled bath tissue fixture thereagainst, the openings configured to receive the roll mount of the standard rolled bath tissue fixture therethrough to couple the housing thereto.

2. The non-refillable dispenser of claim 1, wherein the housing is an integral unit having first and second compartments defined therein.

3. The non-refillable dispenser of claim 2, wherein the housing includes an inner wall which cooperates with the housing to provide a first compartment and a second compartment.

4. The non-refillable dispenser of claim 3, wherein one compartment includes a container configured to hold and dispense therefrom the premoistened sheets.

5. The non-refillable dispenser of claim 1 wherein a container provided in the housing for holding premoistened sheets is configured to provide the first compartment.

6. The non-refillable dispenser of claim 1, wherein the first compartment includes a resealable dispensing opening.

7. The non-refillable dispenser of claim 1, wherein the first compartment is positioned generally above the second compartment.

8. The non-refillable dispenser of claim 1 wherein the at least one pair of openings is positioned through the first compartment, and the first compartment is configured to receive the roll mount therethrough.

9. The non-refillable dispenser of claim 8, wherein the premoistened sheets are disposed in a container which is movable within the housing to avoid a position of the roll mount inserted through the first compartment.

10. The non-refillable dispenser of claim 1, wherein the openings further comprise a plurality of openings positioned on opposing side walls of the housing.

11. The non-refillable dispenser of claim 1, wherein the housing further includes a securing flap which is positionable away from the housing when the dispenser is coupled to a fixture, the securing flap configured to support the housing in a fixed position for dispensing.

12. The non-refillable dispenser of claim 1, wherein when the roll mount is positioned through each slot, it compresses the resilient material thereby firmly positioning the housing for dispensing.

13. A non-refillable dispenser, comprising:

a housing including opposing sidewalls, an upper and lower wall, and a front and back wall, the housing including a first compartment configured to hold and dispense therefrom a plurality of premoistened sheets, and a second compartment configured to hold and dispense therefrom a plurality of dry sheets, a dispensing opening defined in each of the first and second compartments for dispensing sheets therefrom; and a plurality of openings positioned on the opposing sidewalls of the housing, at least one pair of openings of the plurality of openings positioned through the first compartment of the housing and the first compartment configured to receive a roll mount therethrough such that when a roll mount is positioned through the pair of openings, the premoistened sheets are positioned adjacent the roll mount and the housing is supported on a standard rolled bath tissue fixture in a position to facilitate easy removal of premoistened sheets and dry sheets from the housing.

14. The non-refillable dispenser of claim 13, wherein the housing includes an inner wall which cooperates with the housing to provide the first compartment and the second compartment.

15. The non-refillable dispenser of claim 13, wherein the first compartment includes a container configured to hold and dispense premoistened sheets.

16. The non-refillable dispenser of claim 13 wherein a container provided in the housing for holding premoistened sheets is configured to provide at least a portion of the first compartment.

17. The non-refillable dispenser of claim 16, wherein the second compartment is provided by space remaining in the housing not filled by the container.

18. The non-refillable dispenser of claim 13, wherein the first compartment also includes the premoistened sheets which are disposed in a container, the container positioned in the first compartment such that when the roll mount is positioned therethrough via the pair of openings in the housing, the roll mount is positioned above the dry sheets and beside the container of premoistened sheets.

19. The non-refillable dispenser of claim 18, wherein the premoistened sheets are disposed in a container which is movable within the first compartment to avoid a position of the roll mount inserted through the first compartment.

20. The non-refillable dispenser of claim 13, wherein at least the pair of openings each defines a slot having a resilient material positioned to partially block each slot.

21. The non-refillable dispenser of claim 20, wherein when the roll mount positioned through each slot, it compresses the resilient material thereby firmly positioning the housing for dispensing.

22. The non-refillable dispenser of claim 13, wherein the housing further includes a securing flap which is configured to be positioned away from the housing when the dispenser is coupled to a fixture, the securing flap configured to support the housing in a fixed position for dispensing.

* * * * *